US006688087B2

(12) United States Patent
DeCosemo

(10) Patent No.: US 6,688,087 B2
(45) **Date of Patent: *Feb. 10, 2004**

(54) TREELESS JUMPING SADDLE AND METHOD OF MAKING THE SAME

(76) Inventor: Peter A. DeCosemo, 19206 NE. Lehto Rd., Battle Ground, WA (US) 98604

( * ) Notice: Subject to any disclaimer, the term of this patent is extended or adjusted under 35 U.S.C. 154(b) by 0 days.

This patent is subject to a terminal disclaimer.

(21) Appl. No.: 10/223,239

(22) Filed: Aug. 19, 2002

(65) Prior Publication Data

US 2002/0189211 A1 Dec. 19, 2002

Related U.S. Application Data

(63) Continuation-in-part of application No. 09/615,472, filed on Jul. 13, 2000, now Pat. No. 6,434,915.

(51) Int. Cl.[7] ..... B68C 1/02; B68G 1/00
(52) U.S. Cl. ..... 54/44.1; 54/44.7
(58) Field of Search ..... 54/44.1, 44.3, 54/44.5, 44.7, 46.1

(56) References Cited

U.S. PATENT DOCUMENTS 6,434,915 B1 * 8/2002 DeCosemo ..... 54/44.1

* cited by examiner

*Primary Examiner*—Charles T. Jordan
*Assistant Examiner*—Elizabeth Shaw
(74) *Attorney, Agent, or Firm*—Ingrid McTaggart

(57) ABSTRACT

A treeless saddle comprises a layered arrangement of flexible leather and foam, without including a rigid saddletree or frame. In particular, the inventive saddle comprises two lower body half sections sewn together to define a saddle body. An underside of said saddle body includes two back contacting pads that define a recessed gullet region therebetween. A removable gullet pad may be provided for releasable securement with the gullet region. The saddle further comprises additional layers of soft leather and foam shaped to define an upwardly extending pommel, an upwardly extending cantle, and a lowered seat area positioned therebetween. The arched and contoured shape of the saddle, therefore, is defined by soft foam and leather and not by a rigid steel or wooden internal frame.

22 Claims, 11 Drawing Sheets

Fig. 6
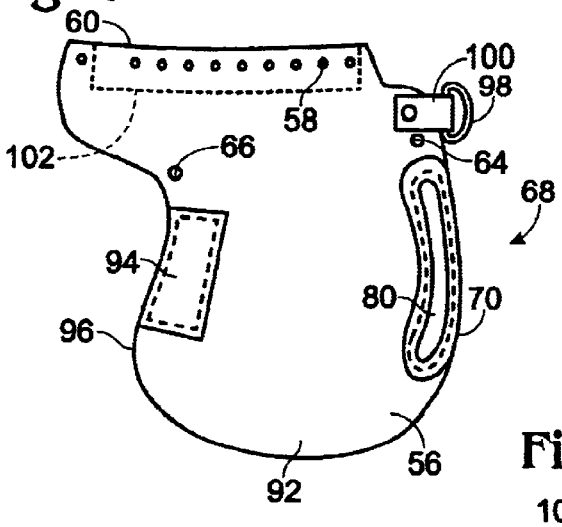
Fig. 7
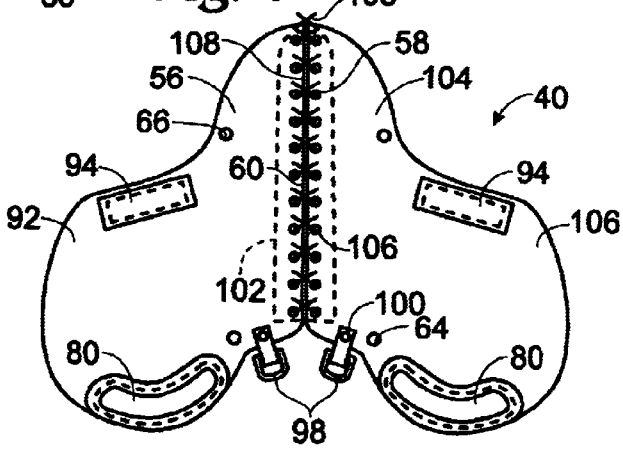
Fig. 8
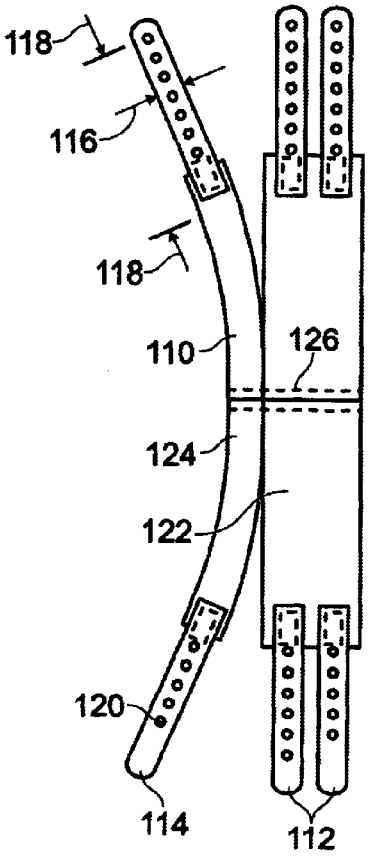
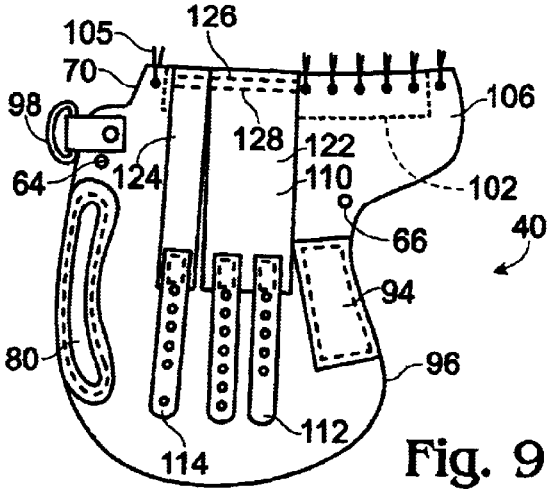
Fig. 9

Fig. 36
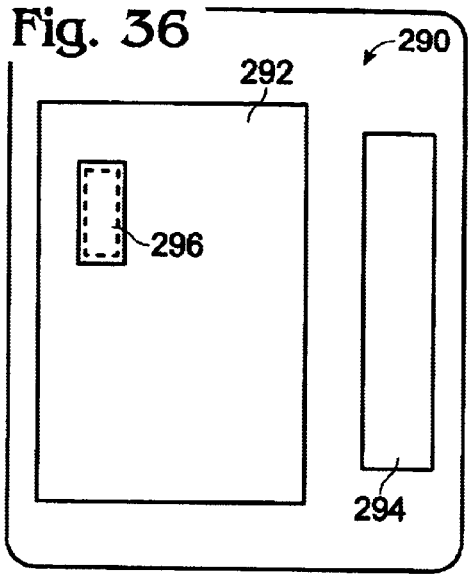
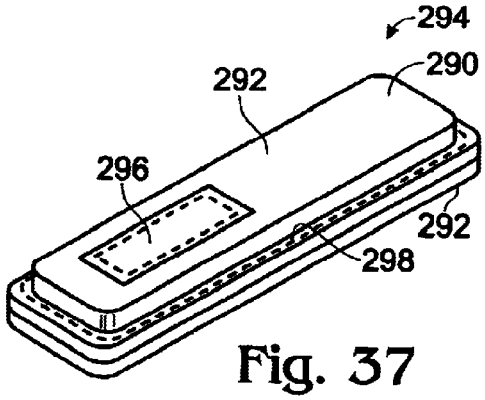
Fig. 37
Fig. 38
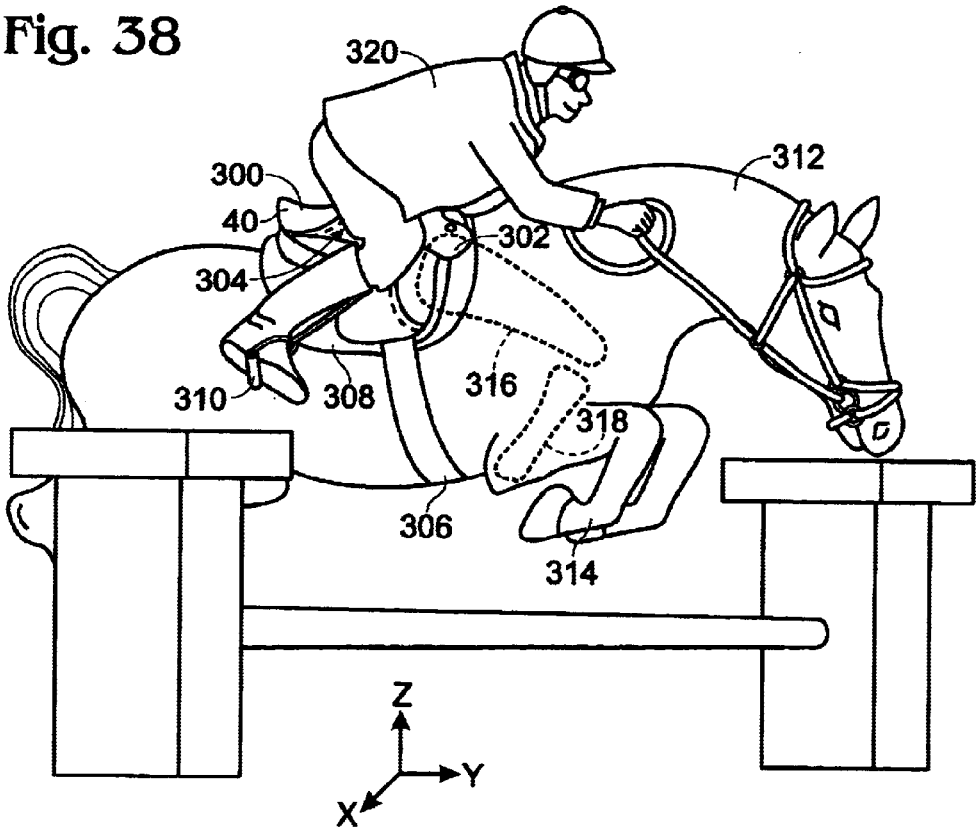

TREELESS JUMPING SADDLE AND METHOD OF MAKING THE SAME

This application is a Continuation-in-Part of U.S. patent application Ser. No. 09/615,472, filed on Jul. 13, 2000 now U.S. Pat. No. 6,434,915.

TECHNICAL FIELD

The present invention relates to a treeless jumping saddle and a method of making the same, and more particularly, to a treeless jumping saddle that provides a fully flexible saddle which conforms to and continuously contacts a horse's back during all types of movement, while simultaneously providing contoured support for a rider which enables the rider to fully communicate with the horse.

BACKGROUND OF THE INVENTION

Throughout history saddles have facilitated riders in remaining mounted on their horse. Early saddles comprised a simple, flat saddle blanket secured to the back of a horse. This simple design facilitated the rider in remaining on the horse during calm movements, such as walking, but did not help the rider to remain on the horse during faster movements such as galloping or jumping. With the arrival of organized warfare a more substantial saddle was developed which included a rigid saddletree that anchored a soldier in the saddle and rendered him difficult to dislodge by his opponents.

These rigid saddletrees were thought to distribute the weight of the rider evenly over the horse's back by providing a frame that defined a gullet, i.e., a spacing of the saddle from the backbone ridge of the horse. This rigid frame design with a gullet was thought to ease the workload of the horse. Spacing of the rigid frame from the horse's backbone ridge was also thought to evenly distribute the weight of the rider. Rigid saddletrees were also thought to provide the rider with a stable support base from which to control the horse by providing a permanent arched shape to the saddle including a raised pommel, a raised cantle and a lowered seat area positioned therebetween. Due to these perceived benefits, rigid saddletrees have become standard in virtually all saddle designs.

In the environment of hunting and sporting, i.e., eventing, such as steeplechase and jumping competitions, the rider is often positioned up and outwardly of the saddle. During the first part of a jump, as the horse is ascending upwardly and over an obstacle, the rider's torso is generally positioned forwardly over the horse's withers with the rider's knees pressing into the side of the horse behind the horse's shoulders. During the second part of a jump, as the horse is descending downwardly over the obstacle, the rider is generally positioned reawardly, leaning back and often standing in the saddle, with the rider balancing their weight in the stirrups and by pressing their knees into the side of the horse behind the horse's shoulders. The range of motion and physical demands on saddle and horse during eventing are generally much greater than during technical events such as dressage and more common riding situations such as trail riding. Due to the heightened need for balance and control during such rigorous eventing conditions, saddles having rigid saddletrees have been thought to be indispensible for such eventing use.

Rigid saddletrees, however, have several disadvantages. During use the rigid frame is forced downwardly into and against the horse's back and shoulders by the weight of the rider. This rubbing and downward force of the rigid saddletree can result in saddle sores to both horse and rider. In more extreme cases, the rigid frame substantially limits performance of the horse by preventing free movement of the horse's front legs at the shoulders. Another disadvantage is that saddles manufactured with rigid saddletrees do not conform to the shape of the horse so that with each movement of the horse, such as breathing and striding, the frame is forced against the horse's back and sides. Moreover, due to the expense of manufacturing saddles, only a single sized rigid saddle may be available for a variety of horses each having a unique size.

In the environment of eventing, where rigid saddletrees are thought to be most needed, Applicant has found that such rigid saddletrees can pose the greatest problems. In particular, during ascent of the horse over an obstacle, the rigid saddletree may limit performance of the horse by hindering rotation of the horse's shoulders such that the horse is not able to clear a jump. During landing of the horse after descending from an obstacle, the weight of the rider jams the points of the rigid saddletree into the horse's back with a force much greater than experienced by the horse during dressage or trail riding. Such rigid saddletrees also limit "contact" of the rider's knees and inner thighs with the horse, thereby limiting communication between the horse and rider. Accordingly, such rigid saddletrees can decrease the performance of the horse and rider, cause pain to both horse and rider, and in some cases, cause injury to the horse and rider, and cause behavioral problems by the horse, during the rigorous demands of eventing competition.

SUMMARY OF THE INVENTION

Accordingly, an object of the present invention is to provide a fully flexible, treeless jumping saddle which conforms to the shape of a horse's back.

Another object of the present invention is to provide a treeless saddle that provides contoured support for a rider and which enables the rider to fully communicate with the horse.

Still a further object of the present invention is to provide a treeless jumping saddle that is substantially more comfortable for both horse and rider.

Yet another object of the present invention is to provide a treeless jumping saddle having an outer shape and design which conforms to international riding regulations.

Still another object of the present invention is to provide a flexible jumping saddle that conforms to the shape of each individual horse, regardless of the horse's size.

A further object of the present invention is to provide a treeless jumping saddle that does not restrict movement of the shoulders of the horse.

Yet another object of the present invention is to provide a treeless jumping saddle that does not punish the horse for doing his job properly.

Accordingly, the treeless jumping saddle of the present invention preferably comprises a layered arrangement of flexible leather and foam, and does not include a rigid saddletree or frame. In particular, the inventive saddle comprises two lower body half sections sewn together, with two back pads secured to an underside thereof. The underside of the pads are in form fitting contact with the back of the horse generally across the under surface area of the saddle, but define a recessed gullet region. Accordingly, the two flexible back pads form a gullet without requiring a rigid saddle tree. The saddle further comprises additional layers of soft leather and foam shaped to define an upwardly extending pommel, an upwardly extending cantle, and a lowered seat area positioned therebetween. The arched and contoured shape of the saddle, therefore, is defined by soft foam and leather and not by a rigid steel or wooden internal frame. Accordingly, the rider is received in a contoured seat which meets international riding regulations and which facilitates communication between the horse and rider. Moreover, the flexible form fitting saddle of the present invention provides a gullet, which increases lateral stability of the saddle, thereby meeting the increased demands on rider and horse during rigorous eventing competition.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 6 is a top view of the right half section of the saddle body;

FIG. 7 is a top view of two half sections of the saddle body sewn together;

FIG. 8 is a top view of the billet assembly of the treeless saddle;

FIG. 9 is a side view of the billet assembly sewn to the two half sections of the saddle of FIG. 7;

FIG. 36 is a top view of the components of a gullet pad;

FIG. 37 is a perspective view of the assembled gullet pad; and

FIG. 38 is a perspective view of the treeless jumping saddle in use.

DETAILED DESCRIPTION

Figure 1:
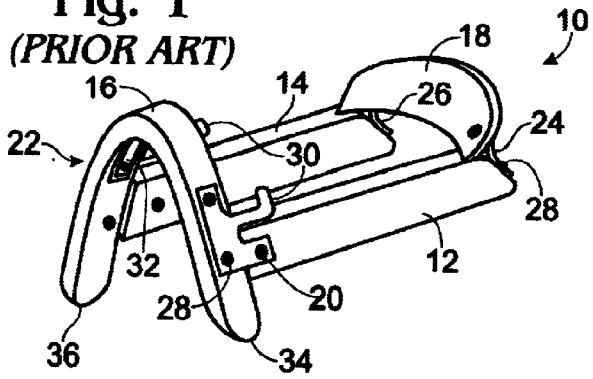
Fig. 1 (PRIOR ART)
FIG. 1 is a perspective view of a prior art rigid saddletree.

Referring to FIG. 1, a prior art rigid saddletree 10, also called a tree or a frame, typically is positioned within the outer covering of a prior art saddle (not shown). Rigid saddletree 10 comprises two side bars 12 and 14, an arched front section 16, also called a pommel, and a contoured rear seat 18, also called a cantle. Side bars 12 and 14, pommel 16, and cantle 18 are manufactured of rigid material, typically wood or metal. In the prior art embodiment shown, the frame is manufactured of wood wherein steel braces 20, 22, 24 and 26 are fastened to the individual wooden pieces by fasteners 28 to rigidly secure the frame together. Front steel braces 20 and 22 also include rearward extending hooks 30 for the attachment of stirrups thereto (not shown) for support of the rider's feet. Pommel 16 may also include a steel support brace 32 to ensure the wooden arch holds its shape during use. Pommel 16 further includes two lower "points" 34 and 36.

In use, side bars 12 and 14 are placed along the back of the horse straddling the spine, wherein the weight of the rider forces the bars downwardly into the horses back and shoulders. This may inhibit the horse's performance and/or lead to injury of the horse's back or shoulders. The frame provides a rigid support base for the rider which isolates the rider from fully sensing the movements of the horse. Moreover, the rigid frame hinders the horse from sensing subtle movements of the rider. Accordingly, in general, the rigid frame inhibits communication between horse and rider.

When the rigid saddletree of the prior art is secured to a horse, the pommel part of the rigid tree is placed over or just rearwardly of, but still in contact with, the back edge of the horse's shoulder blade, also called a scapula, when the horse is in the standing position. The rigid saddletrees of the prior art cannot be placed more rearwardly on a horse because the horse's back becomes too flat so that side bars 12 and 14 would not contact the sides of the horse but instead would stand up on the horse's back.

Upon movement of the horse, the front legs of the horse move forwardly which rotates the scapula rearwardly and into or under the rigid saddletree. This contact of the horse's scapula with the rigid saddletree can be quite painful. When the horse gallops or canters, the hind end of the horse thrusts upward and forward, thereby thrusting the rigid saddletree and the rider forward. This movement further forces the rigid frame into the horse's shoulders. Moreover, the movement is exaggerated during eventing when the horse jumps upwardly and over obstacles. In particular, lower pointed ends 34 and 36 of the pommel region dig into the horse's shoulders with each stride. When a rider places his weight on the stirrups, instead of on the saddle seat, the forward position of the stirrup hooks 30 causes rear cantle 18 to rise up above the horse's back, and causes front pommel 16, and points 34 and 36, to further dig down into the horse's shoulders. The rigid frame construction of the prior art does not allow one to position the saddle rearwardly of the horse's shoulder blades because the scapula acts as a brake on this forward movement of the saddle when weight is placed on the stirrups or when the horse runs.

Figure 2:
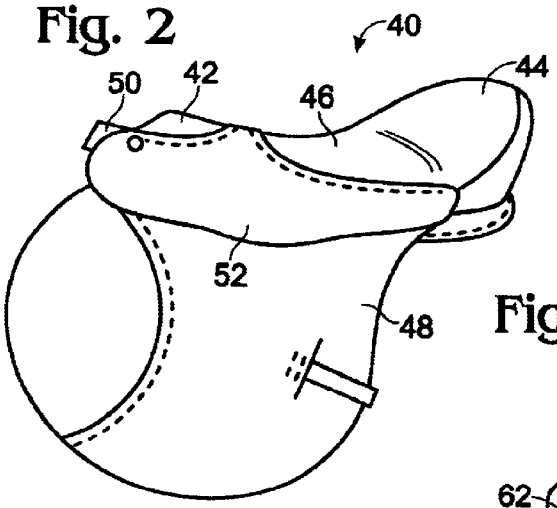
FIG. 2 is a side view of one embodiment of the treeless jumping saddle of the present invention.

FIG. 2 shows a preferred embodiment of the flexible treeless saddle 40 of the present invention including a flat, cutback, jumping style pommel 42, an upwardly extending cantle 44, and a lowered seat portion 46 positioned therebetween. The saddle further comprises an outer side flap 48, a gullet pad 50, and a skirt 52. The method of making the saddle of the present invention will be shown in a step by step fashion.

Figure 3:
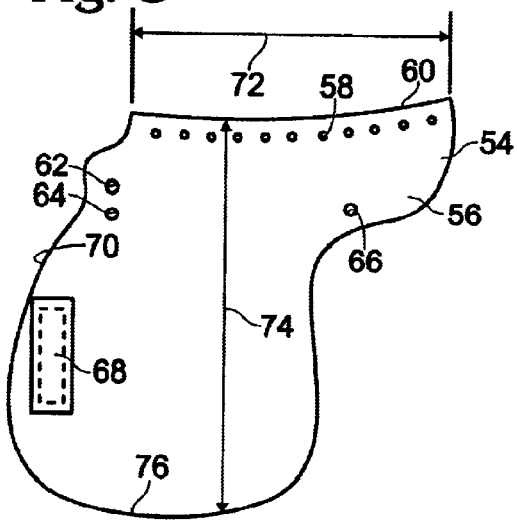
FIG. 3 is a bottom view of the right half section of the saddle body.

FIG. 3 shows an underside 54 of one half section 56 of two mirror image body half sections which are each cut from latigo chard, eight to nine ounce weight leather. The half section 56 shown is a right side piece, meaning that when the top of the completed saddle is viewed from the top, with the pommel of the saddle positioned forwardly from the cantle, half section 56 will be positioned on the right side of the saddle. As will be understood by those skilled in the art, the saddle of the present invention can be manufactured of any flexible material such as leather, flexible plastic, material, or the like, in any desired weight, strength, color or thickness. The saddle may also be manufactured in any size as is desired for a particular application. Accordingly, Applicant describes herein the method of making the inventive saddle according to one embodiment but is not limited to this particular embodiment. Moreover, many of the steps of the method of the present invention involve mirror image steps wherein only one of the mirror image steps is described for the sake of brevity.

Half section 56 is punched with stitching apertures 58 along an upper edge 60 of the section (typically eleven stitching apertures are punched), D-ring aperture 62 in a forward portion of the section, side flap aperture 64 below D-ring aperture 62, and a second side flap aperture 66 in a rear portion of the half section. A fastener 68 is secured on a forward edge 70 of section 56 by both gluing and stitching. When gluing components of the saddle, typically quick drying all purpose rubber cement is used, though other adhesives may also be used. Fastener 68 typically comprises a five point five (5.5) inch long strip of hook or pile material (corresponding mating hook or pile material is sewn to the underside of a shoulder column, as will be described in more detail below). In this embodiment, fastener 68 is sewn to section 56 with the top portion of the fastener positioned approximately two point five (2.5) inches down from rivet hole 64. This process is then repeated for the second, left half section of the saddle (not shown). The half sections typically have a width 72 measured along upper edge 60 of approximately seventeen (17) inches, and a length 74 measured from upper edge 60 downwardly to a lower edge 76 of approximately eighteen and a half (18.5) inches.

Figure 4:
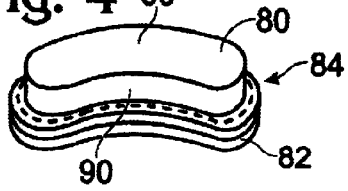
FIG. 4 is a top perspective view of a detachable knee roll.
Figure 5:
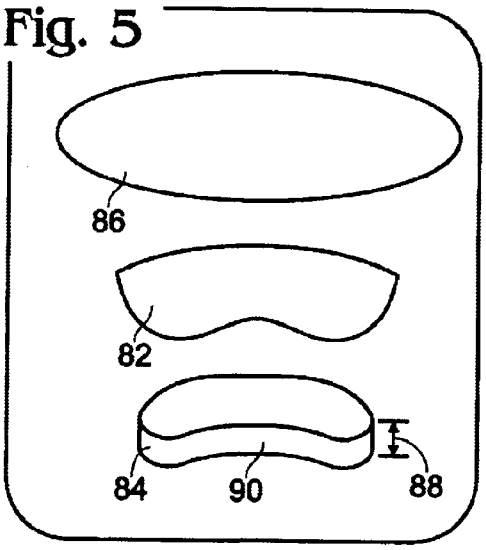
FIG. 5 is a top view of the components used to make the knee roll of FIG. 4.

FIGS. 4 and 5 show the components and finished assembly, respectively, of a knee roll 80. Knee roll 80 includes a bottom piece 82 of latigo chard, eight to nine ounce weight leather, an insert 84 of pre-molded two-part polyurethane material (referred to herein as "2 PPM") molded by an open pore compression system, and a soft leather cover 86. The soft leather typically comprises tumble soft pebble, four to five ounce weight leather, but other softness and weights of durable material may be used. Pre-molded insert 84 typically has durometer measurement of 31 to 34A weight, a thickness 88 of approximately two (2) inches and a contoured shape for receiving a rider's knee in a recessed region 90 thereof.

FIG. 6 shows a top side 92 of right half section 56 of the saddle. A fastener 94 is glued and sewn to top side 92 adjacent a rear edge 96. Fastener 94 typically comprises a five point five (5.5) inch long strip of hook or pile material (corresponding mating hook or pile material is sewn to the underside of a thigh block, as will be described in more detail below). In this embodiment, fastener 94 is sewn to section 56 with the top portion of the fastener positioned approximately three point five (3.5) inches down from rivet hole 66. Knee roll 80 is glued and sewn to top side 92, adjacent front edge 70, and on an opposite side of section 56 from fastener 68. Knee roll 80 typically is secured to section 56 approximately one point five (1.5) inches down from forward side flap aperture 64. A D-ring 98 is then secured to section 56 by a strip of leather 100 riveted to aperture 62. A stitch line 102, shown in dash lines, is then marked approximately one point five (1.5) inches below upper edge 60 of section 56. Stitch line 102 marks where a bottom cover (not shown) will be sewn to the half sections of the saddle later in the assembly process. This process is then repeated for the second, left half section of the saddle (not shown).

FIG. 7 shows two half body sections 56 and 104 sewn together using artificial sinue thread by stitching 105. The stitching is tied off individually at each of apertures 58 aligned along top edge 60 of each of the half sections. When the two half sections are sewn together they define a central saddle body 106. Central saddle body 106 does not lay completely flat because upper edge 60 of each of the half body sections has a slight curvature (shown in FIG. 3). Accordingly, central saddle body 106 has a slightly arched shape along its central seam 108. The saddle body can be described as defining a smooth, continuous arched underside.

FIG. 8 shows the billet assembly 110 of the treeless saddle. In this embodiment, billet assembly 110 includes a first set of four billet straps 112 and a second set of two billet straps 114 (also called girth attachment straps). The billet straps are cut from skirting leather having a weight of twelve to fourteen ounces. Billet straps 112 and 114 each have a width 116 of approximately one (1) inch and a length 118 of approximately twelve (12) inches. Other sized billet straps may be used for different sized saddles. Seven girth holes 120 are punched one (1) inch apart in each of the billet straps. In the preferred embodiment the billet straps are cut from light brown leather. An edging process may be used to round the edges of the billet straps so that the straps are comfortable to handle when securing the girth strap (not shown) to the saddle. Billet straps 112 are secured by stitching to a length of webbing 122, and billet straps 114 are secured by stitching to a length of webbing 124, such as nylon webbing similar to that used for automobile safety seat belts. Webbing pieces 122 and 124 typically are each thirty six (36) inches long and are folded over upon themselves and sewn with stitching 126 in a central region thereof to define webbing sections approximately eighteen (18) inches long. Folding of the webbing over upon itself doubles the strength of the billet assembly so that the saddle may be securely fastened to the horse. Webbing piece 124 typically has a width of one (1) inch whereas webbing piece 122 typically has a width of two point two five (2.25) inches. Use of two webbing pieces 122 and 124 further insures the safety of the rider in that the saddle will remain secured to the horse even if one webbing piece becomes broken or damaged.

FIG. 9 shows the billet assembly 110 glued and sewn to saddle body 106 with stitching 128. The front portion of webbing piece 124 typically is positioned approximately two (2) inches rearwardly from the front edge 70 of saddle body 106.

Figure 10:
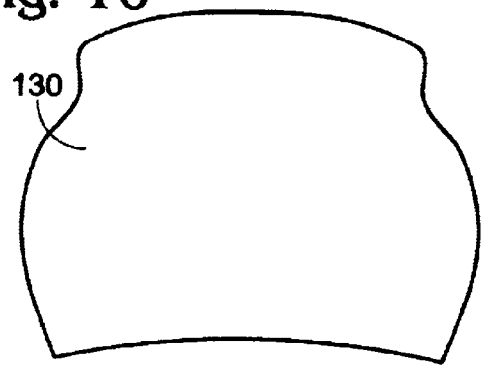
FIG. 10 is a top view of a bottom cover piece of the treeless saddle.

FIG. 10 shows a top view of a bottom cover piece 130 of the treeless saddle. Bottom cover piece 130 typically is cut from heavy pebble leather.

Figure 11:
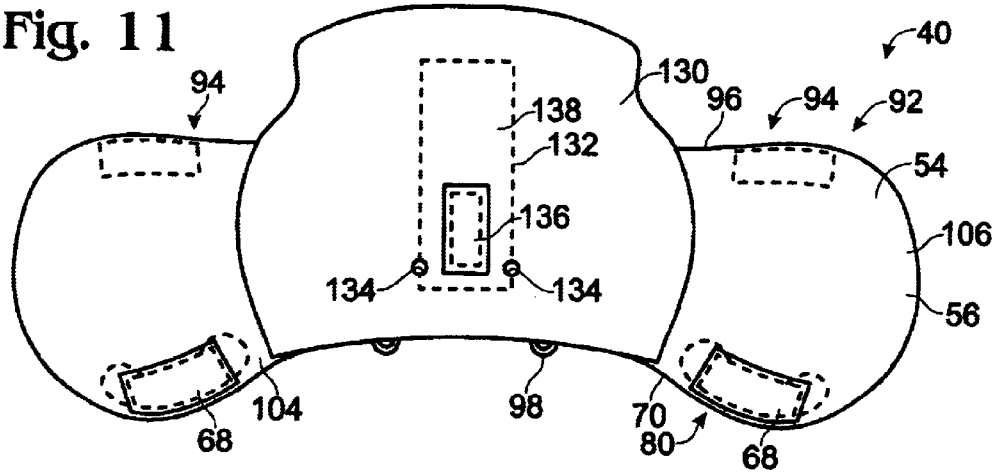
FIG. 11 is a bottom view of the two half sections of the saddle of FIG. 7, with the bottom cover piece sewn thereto.

FIG. 11 shows bottom cover piece 130 glued and sewn in place, by stitching 132, on underside 54 of saddle body 106. The bottom cover piece 130 is generally sewn to the saddle body with topside 92 of the saddle body 106 facing upwardly, wherein stitching 132 is made along previously marked stitch lines 102 (shown in FIG. 7). Two rivet holes 134 are punched through bottom cover piece 130 and through half sections 56 and 104. Rivet holes 134 will be used for securing the stirrup hangers (not shown) to the saddle body later in the assembly process. A fastener 136 is then glued and sewn within a region 138 defined by stitching 132, wherein region 138 will become the gullet region of the saddle. Fastener 136 typically is sewn within region 138 approximately one (1) inch rearwardly from rivet holes 134. Fastener 136 typically is a five point five (5.5) inch long piece of hook or pile material, wherein mating hook or pile material is sewn to a gullet pad, as will be described later in the process, such that a removable and adjustable gullet pad may be secured within gullet region 138.

Figure 12:
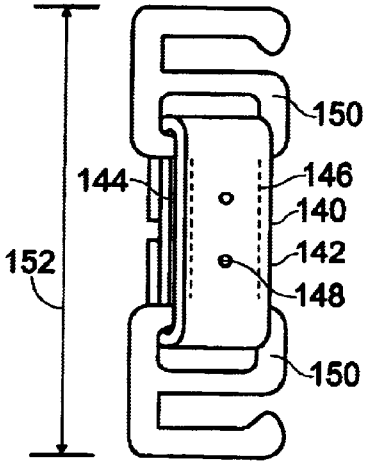
FIG. 12 is a top view of the stirrup hangers.

FIG. 12 shows a stirrup hanger 140, also referred to stirrup hangers, made from a long leather strap 142 and a short leather strap 144 stitched together by stitching 146 and including rivet apertures 148. Each of straps 142 and 144 has a width of approximately one point two five (1.25) inches. The long leather strap captures two break-away stirrup hanger bars 150, which typically are manufactured of a pre-cast, durable and strong material such as metal. Each of the bars 150 measures approximately one (1) inch by one (1) inch and stirrup hanger 140 typically has a length 152 of approximately four (4) inches. Each of bars 150 includes a recess for receiving a stirrup strap as will be understood by those skilled in the art. A rear portion of the recess of bars 150 is open thereby allowing the stirrups to "breakaway" during times of emergency.

Figure 13:
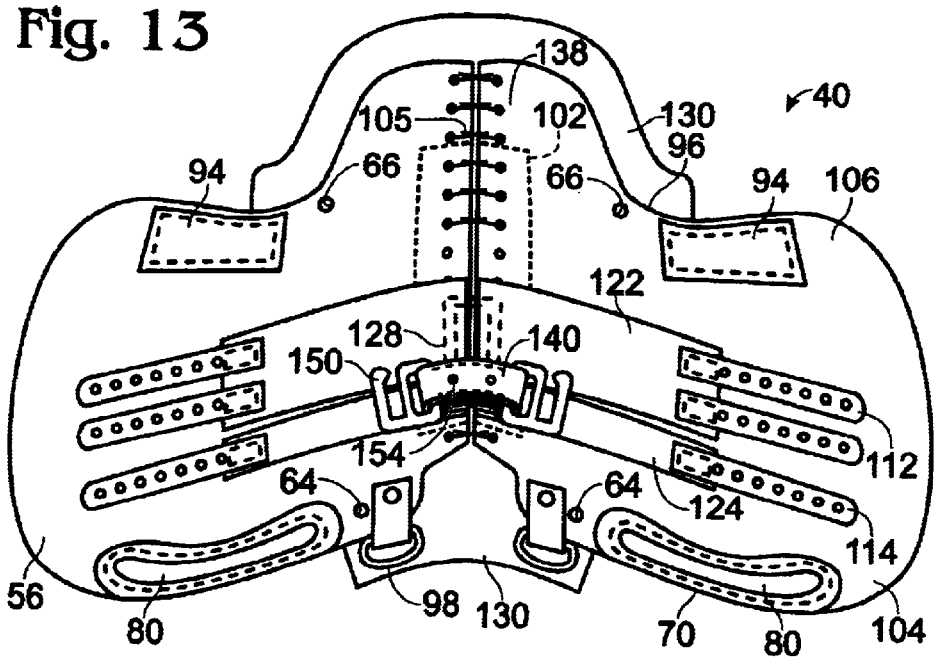
FIG. 13 is a top view of the saddle of FIG. 11 with the stirrup hangers riveted thereto.

FIG. 13 shows stirrup hanger 140 secured to saddle body 106 by rivets 154 positioned through rivet holes 148 in the stirrup hangers and through rivet holes 134 (shown in FIG. 11) punched through bottom cover 130 and saddle body portions 56 and 104. Rivets 154 typically comprise one (1) inch polished copper rivets which are riveted upwardly from the underside 54 of the saddle body through to the topside 92 of the saddle body 106.

Figure 14:
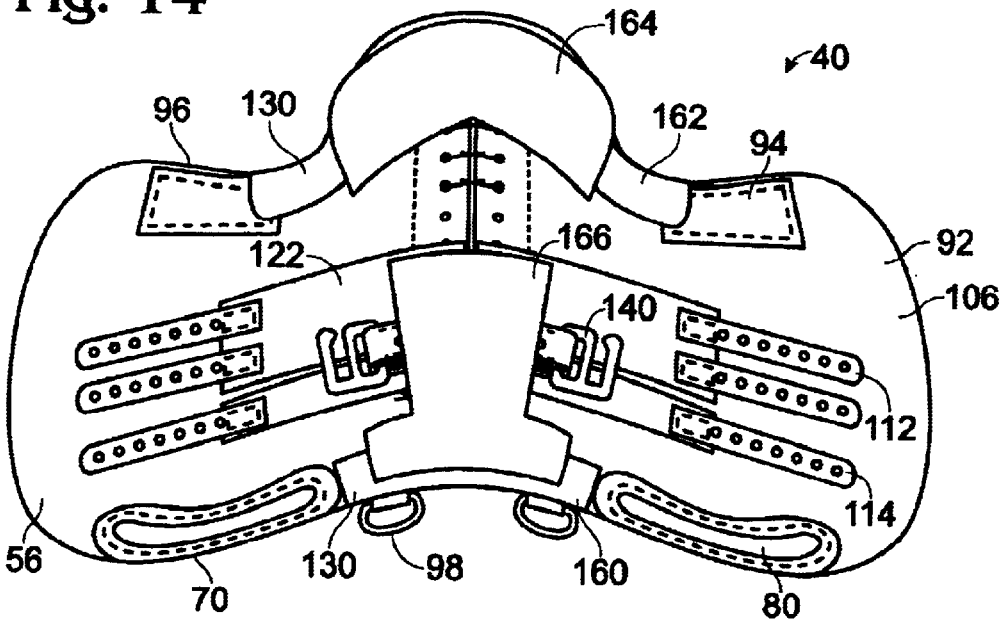
FIG. 14 is a top view of the saddle of FIG. 13 with the bottom cover piece edges pulled around and glued thereto, and a cantle foam piece and a pommel arch piece glued in position on the saddle.

FIG. 14 shows the front binding 160 and the back binding 162 secured in place. In particular, front binding 160 comprises the front edge of bottom cover 130 (shown in FIG. 13) which is pulled over and around front edge 70 of saddle body 106 and glued to topside 92 of the saddle body 106. Back binding 162 comprises the rear edge of bottom cover 130 (shown in FIG. 13) which is pulled over and around rear edge 96 of saddle body 106 and glued to topside 92 of the saddle body 106. The edge of bottom cover 130 in regions 160 and 162 are trimmed as needed before gluing to topside 92 of the saddle body. When securing front binding 160 in place, two slits are made within bottom cover 130 so that D-rings 98 may protrude therethrough. After securing bindings 160 and 162 in place, a seat or cantle piece 164 is glued to a rear region of the saddle body and a pommel piece 166 is glued to a forward region of topside 92 of saddle body 106.

Figure 15:
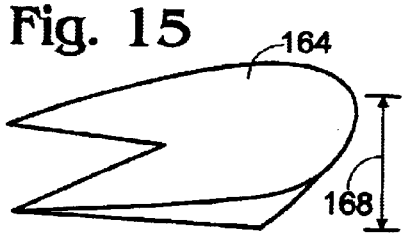
FIG. 15 is a perspective view of the cantle foam piece.

FIG. 15 is a perspective side view of cantle piece 164. Cantle piece 164 typically is pre-molded from 2-PPM and defines a height 168 of approximately three point five (3.5) inches. Cantle piece 164 defines a raised rear section of the finished saddle, which generally will be positioned higher than a seat portion of the finished saddle.

Figure 16:
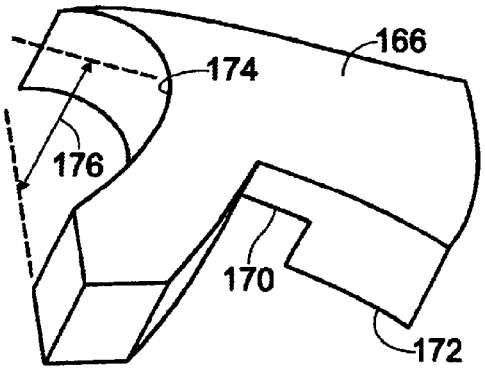
FIG. 16 is a perspective view of the pommel arch piece.

FIG. 16 is a perspective side view of pommel piece 166. Pommel piece 166 typically includes a cutout region 170 on a lower side 172 thereof, wherein cutout region 170 fits over stirrup hanger 140 (shown in FIG. 13) when the pommel piece is secured to the saddle body. Pommel piece 166 further includes a second cutout region 174 that defines the front cutout shape of the finished jumping saddle in the pommel region. Cutout pommel region 174 allows the jumping saddle to be positioned far forwardly on the horse's back without restricting movement of the neck of the horse. Pommel piece 166 may be pre-molded from 2-PPM or may be manufactured of foam. Pommel piece 166 typically defines a height 176 of approximately one and five eighths (1⅝) inches. Cantle piece 164 and pommel piece 166, therefore, define a raised rearward section and a raised forward section, respectively, of the completed saddle, which thereby defines a lower seat portion of the finished saddle. In other words, the raised pommel and cantle define therebetween a contoured seat region, also called a recessed or a form-fitting seat region. Accordingly, the treeless saddle of the present invention defines a flexible saddle that allows communication between horse and rider, yet still provides a contoured shape for securely holding a rider therein.

Figure 17:
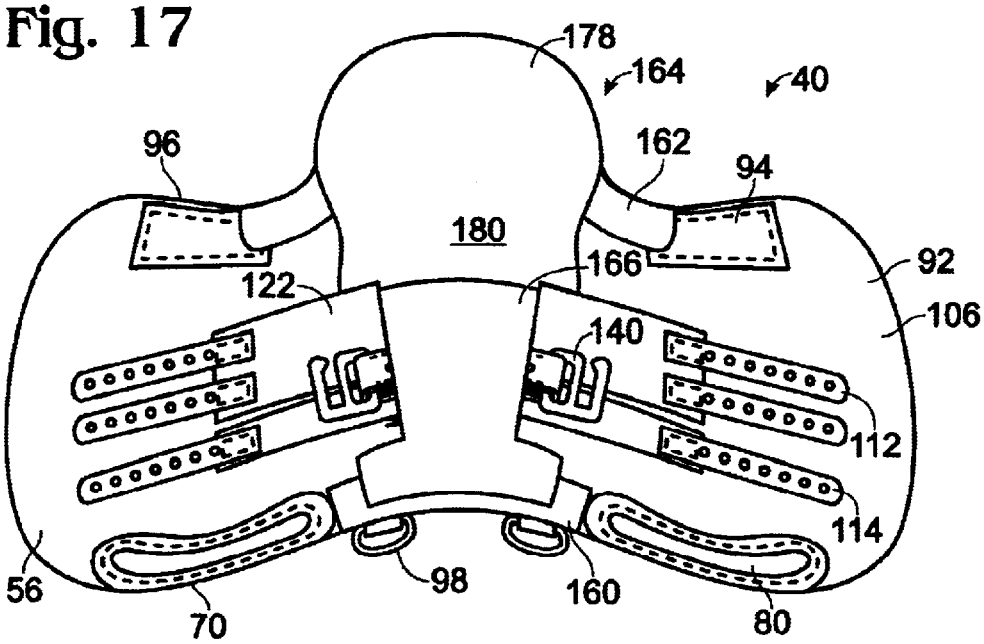
FIG. 17 is a top view of the saddle of FIG. 14 with seat padding secured thereto.

FIG. 17 shows a seat piece 178 positioned and glued on top of cantle piece 164 (shown in FIG. 14) and in central region 180 of topside 92 of saddle body 106. Seat piece 178 typically is manufactured of point (0.5) inch thick multipurpose low-density continuous rolled foam (hereinafter referred to as "MLC foam"). Other flexible materials besides foam may also be used.

Figure 18:
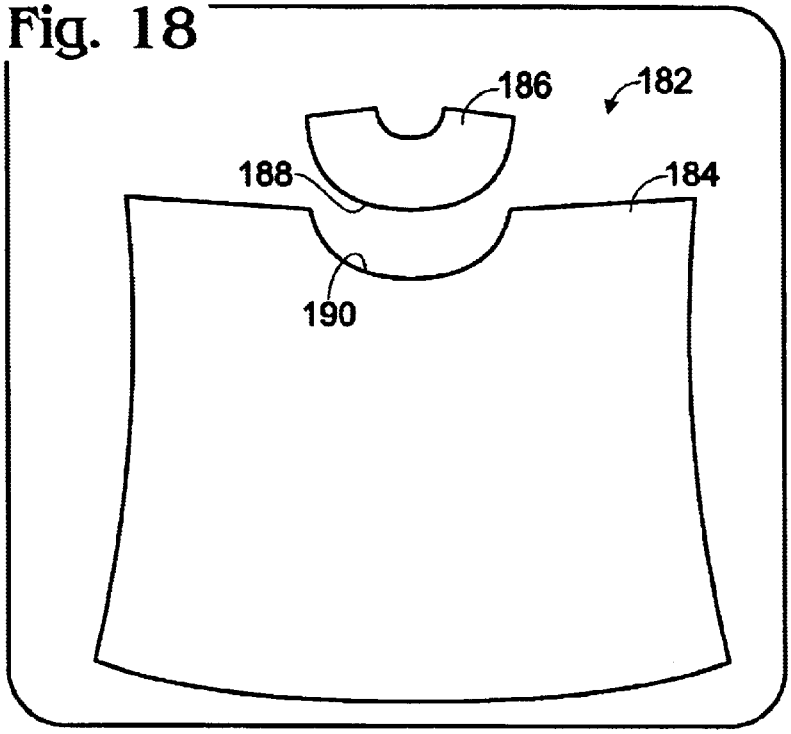
FIG. 18 is a top view of the components of a pommel cover.

FIG. 18 shows a top view of the components for making a pommel cover 182, including a top pommel piece 184 and a front pommel piece 186. Pommel cover 182 is made by sewing top piece 184 to front piece 186 along curved edges 188 and 190, on the bottom side of the pommel pieces. Accordingly, the finished pommel piece will have the stitching hidden on an underside thereof.

Figure 19:
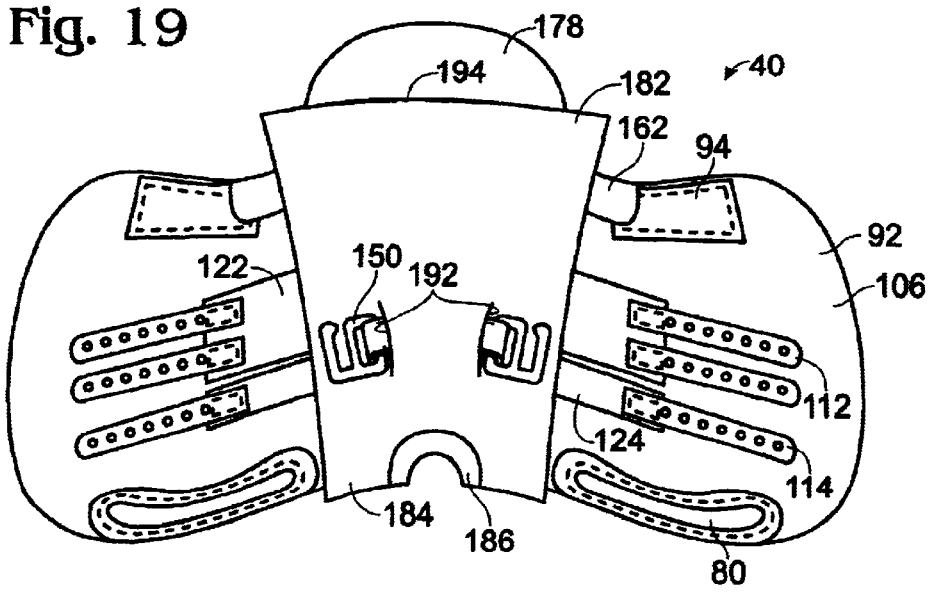
FIG. 19 is a top view of the pommel cover sewn together and positioned on the saddle of FIG. 17, with the ends of the stirrup hangers pulled therethrough.

FIG. 19 shows pommel cover 182 positioned on the saddle of FIG. 17, with two slits 192 cut through pommel cover 182, which allow stirrup hanger bars 150 to protrude therethrough. As will be understood by those skilled in the art, the order of the steps of the present invention can be changed while still resulting in the saddle of the present invention. Accordingly, the order of the steps as recited herein is merely a recitation of the preferred method but other orders of steps may also be used. For example, the stirrup hanger holes can be punched in the pommel cover before or after the pommel cover is secured to the saddle body or before the pommel cover itself is sewn together. The pommel cover may be glued in place on pommel 166 (FIG. 17) with quick drying all purpose cement. In this glued position pommel cover 182 completely covers the pommel arch and extends downwardly over billet webbing 122 and 124. A rear edge 194 of pommel cover 182 extends rearwardly over the front portion of seat pad 178.

Figure 20:
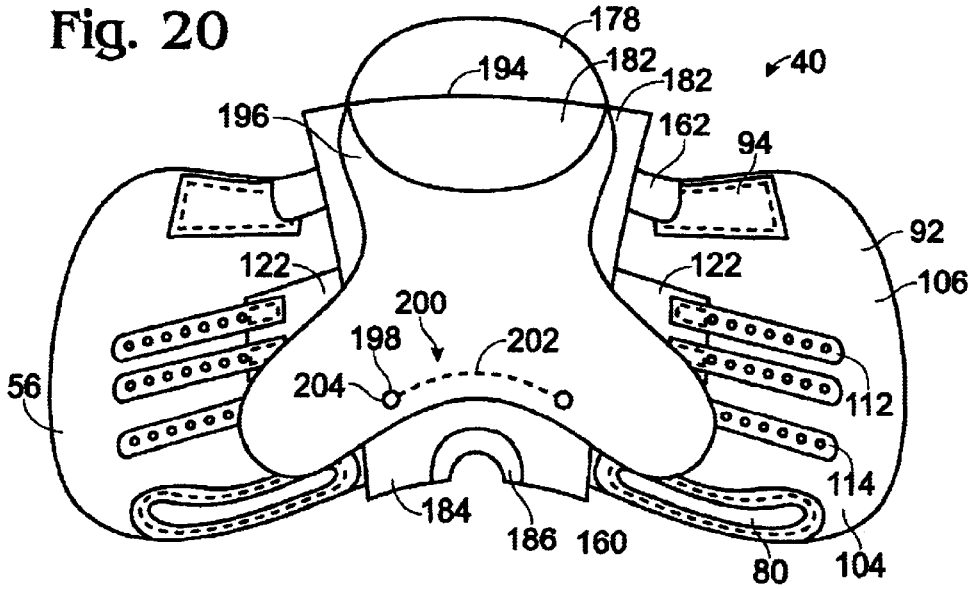
FIG. 20 is a top view of the saddle of FIG. 19 with a saddle skirt sewn and riveted thereto.

FIG. 20 shows a skirt 196 having rivet holes 198 in a forward region 200 thereof. Skirt 196 may be cut from nine pound latigo leather, or any other such flexible and durable material. Skirt 196 is secured on saddle body 106, over pommel cover 182 by gluing the skirt to pommel cover 182, by stitching 202 in forward region 200, and by rivets 204 which extend through rivet holes 198 in skirt 196 and through pommel cover 182.

Figure 21:
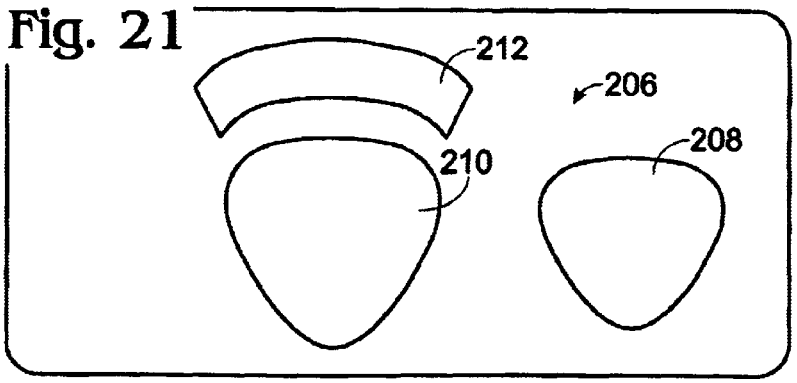
FIG. 21 is a top view of the components of a seat cover.

FIG. 21 shows the components of a seat cover 206 of the treeless saddle. The pieces include a cantle pad 208 made from cross linked polyethylene, one quarter (0.25) inch thick, two pound weight foam, a cantle cover 210 manufactured of tumble soft pebble, four to five ounce weight leather, and a seat back 212 manufactured of tumble soft pebble, four to five ounce weight leather. Seat cover 210 is slightly larger than foam pad 208 and has the same diamond type shape. To assembly seat cover 206, pad 208 is glued to an underside of cantle cover 210. Seat back 212 is sewn to cantle cover 210 on an underside thereof so that when the seat cover is assembled, the stitching between cover 210 and back 212 is hidden on an underside thereof.

Figure 22:
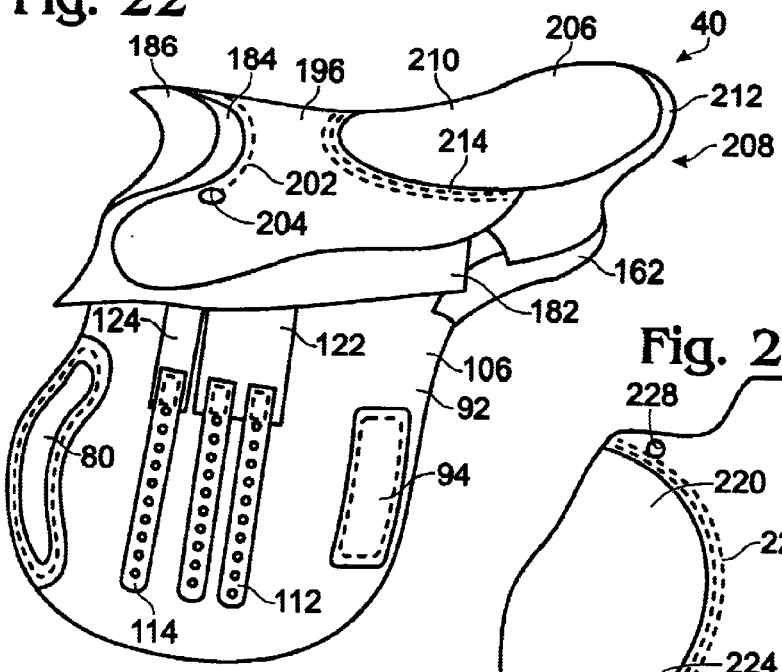
FIG. 22 is a top view of the seat cover sewn together and secured to the saddle of FIG. 20.

FIG. 22 shows assembled seat cover 206 positioned on seat padding 178 (FIG. 20) and in position for gluing thereto. Before gluing, back cover 212 is pulled upwardly and forwardly over cantle cover 210 so that the stitching is exposed and so that the cantle cover 210 is flat and smooth for gluing to seat padding 178. With the cantle cover hand stretched and smoothed out over cantle pad 178, the cover is glued to pad 178, using quick drying all purpose cement, completely across the undersurface of cantle pad 208. Back cover 212 is then pulled rearwardly and downwardly over the rear edge of padding 178. The rear portion of skirt 196 is placed over seat cover 206 and glued and sewn thereto with stitching 214. The front portion 186 of pommel cover 182 is then glued to the front, upper surface 92 of saddle body 106 and front binding 160 (shown in FIG. 17).

Figure 23:
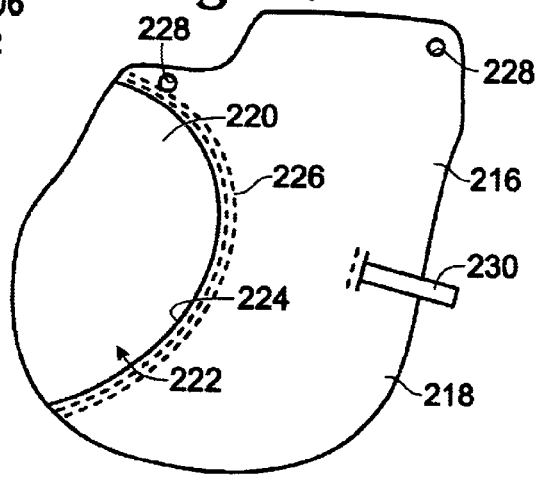
FIG. 23 is a top view of a left side leg flap.

FIG. 23 shows an assembled left side outer leg flap 216 including a leg panel 218, two pieces of padding cover 220 (only one padding cover can be seen in this view) having a generally oval shape, and a pad 222 positioned therebetween. Leg panel 218 may be manufactured of nine pound latigo leather, padding covers 220 may be manufactured of heavy pebble leather, and pad 222 may be manufactured of point five (0.5) inch thick MLC foam. To assembly leg flap 216, pad 222 is glued between covers 220. Covers 220 are then sewn together around their edges and along front curved edge 224 of panel 218 by stitching 226. Rivet holes 228 are punched in flap 216, wherein the rivet holes are positioned within the flap so as to align with corresponding sets of rivet holes 64 and 66 (shown in FIG. 13) of the saddle body 106. Leg flap 216 may further include a stirrup keeper 230 for keeping the loose ends of the stirrup leathers.

Figure 24:
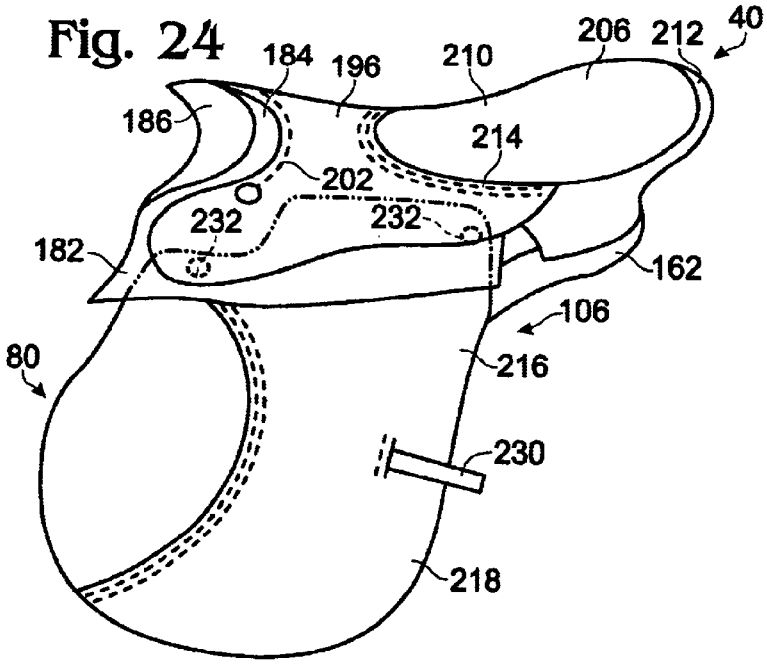
FIG. 24 is a side view of the saddle of FIG. 22 with the leg flap of FIG. 23 riveted and sewn thereto.

FIG. 24 shows left leg flap 216 secured to the saddle of FIG. 22 by two rivets 232 (shown in dash lines, positioned underneath skirt 196). Leg flap 216 covers the lower portion of saddle body 106 such that knee roll 80 (FIG. 22), fastener 94 and billet straps 112 and 114 are covered by leg flap 216.

Figure 25:
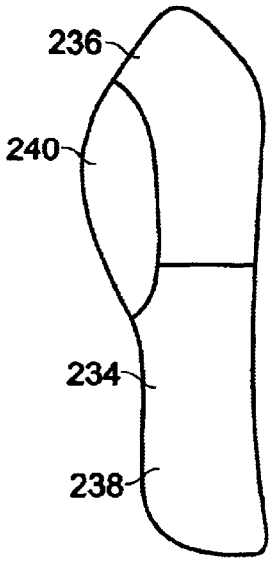
FIG. 25 is a top view of a sculpted back panel.
Figure 26:
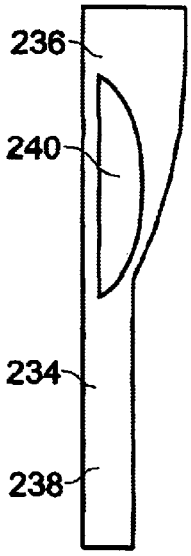
FIG. 26 is a side view of the back panel of FIG. 25.

FIGS. 25 and 26 show a top view and a side view, respectively, of a sculpted back panel 234. Back panel 234 includes a top portion 236 having a thickness greater than a thickness of a lower portion 238, such that top portion 236 slopes downwardly toward lower portion 238. A portion of the panel is cut, sanded or otherwise shaped to define a recessed region 240, also referred to as a sculpted region, which receives the rider's inner thigh, i.e., which allows the rider's inner thigh to be in close communication and contact with the horse. In other embodiments the panel may be pre-molded to have such a sculpted region 240. Sculpted region 240 is cutaway from the remainder of the panel so that when back panel 234 of the saddle is placed on a horse's back, sculpted region 240 will allow for close contact of the rider's thigh with the horse's back or dorsal region. Panel 234 may be manufactured of point five (0.5) inch thickness cross linked polyethylene foam (hereinafter referred to "XPE foam") glued together to define the thickness of the panel. Top portion 236 typically has a thickness of one point five (1.5) inches whereas lower portion 238 typically has thickness in a range of point five to one (0.5 to 1.0) inches. Prior to gluing to the underside of the saddle, the edge of back panel 234 may be sanded or smoothed, so as to provide for a smooth edge for contact with the horse's back and shoulders.

Figure 27:
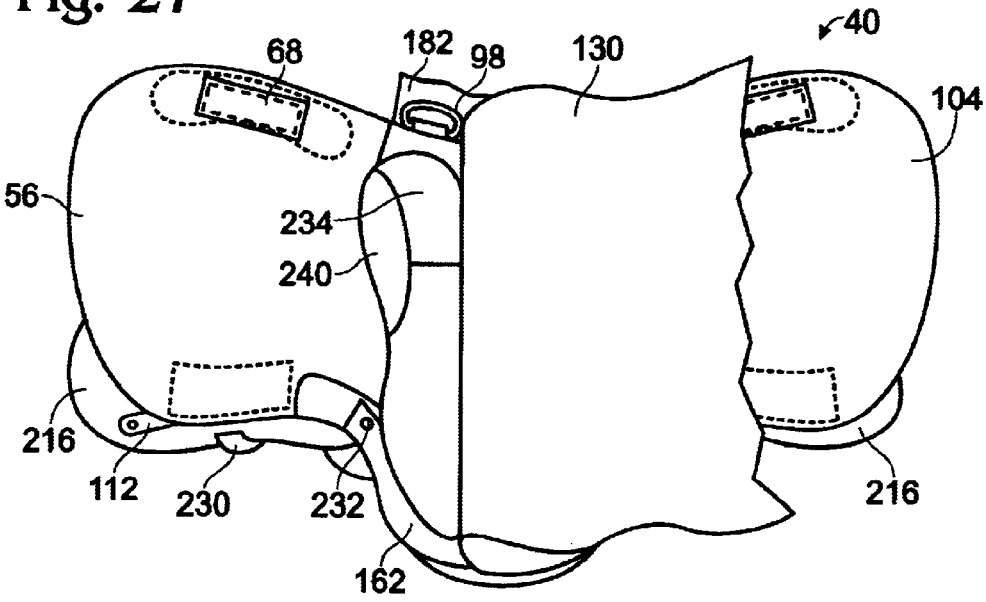
FIG. 27 is a bottom view of the saddle of FIG. 24 with the bottom cover piece pulled to one side and one back panel glued in position.

FIG. 27 is a bottom view of the treeless saddle wherein sculpted back panel 234 is glued to underside 54 of right half section 56. To glue back panel 234 to section 56, bottom cover piece 130 is pulled to one side. Cover piece 130 is not completely removed because it has been sewn to saddle body 106 by stitching 132 in gullet region 138 (shown in FIG. 1). The cover piece is then pulled to the other side to glue the other sculpted back panel in place on the left half section 104.

Figure 28:
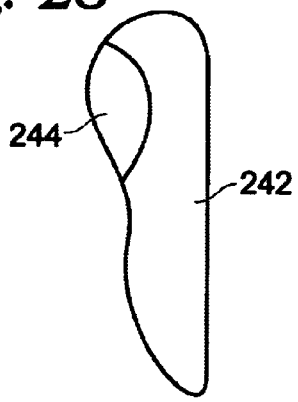
FIG. 28 is a top view of a sculpted back foam piece.
Figure 29:
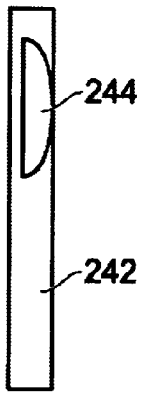
FIG. 29 is a side view of the back foam piece of FIG. 28.

FIGS. 28 and 29 show a top view and a side view, respectively, of a sculpted back pad 242 having a cutout or sculpted region 244. Back pad 242 may be manufactured of point five (0.5) inch thick MLC foam. Sculpted region 244 generally has a thickness approximately half of that of the remainder of the pad and is positioned to be aligned with sculpted region 240 of back panel 234 (shown in FIG. 27).

Figure 30:
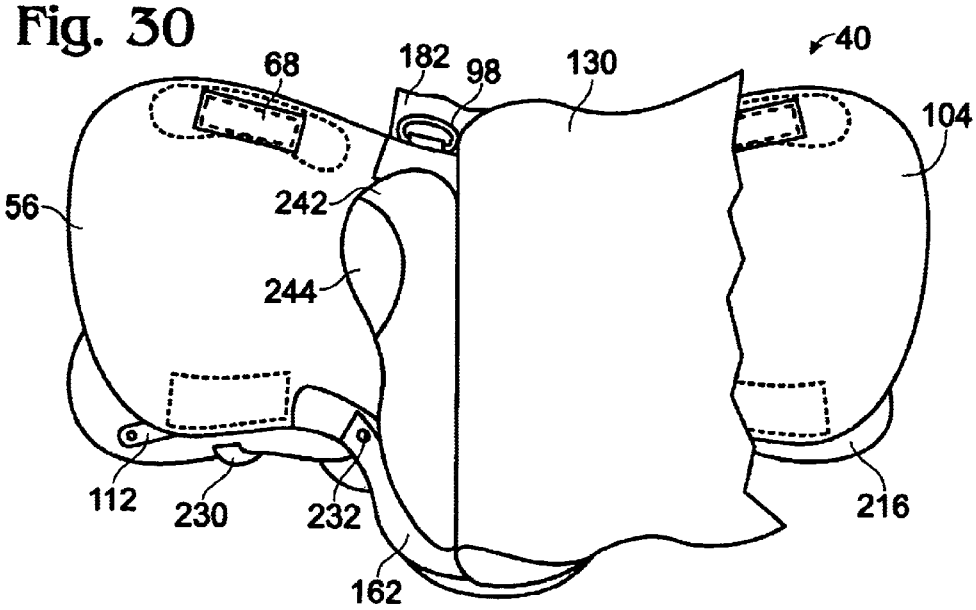
FIG. 30 is a bottom view of the saddle of FIG. 27 with one back foam piece secured to the sculpted back panel.

FIG. 30 shows a bottom view of the treeless saddle wherein sculpted back pad 242 is glued to back panel 234 on right half section 56 of the treeless saddle. Once again, bottom cover piece 130 is pulled to one side as each back pad is glued to its corresponding back panel.

Figure 31:
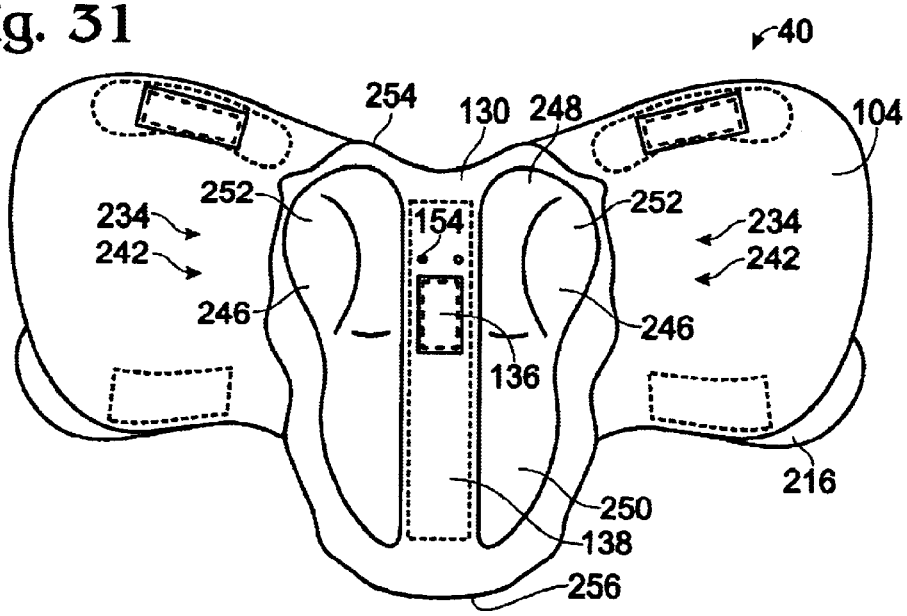
FIG. 31 is a bottom view of the saddle of FIG. 30 with both back panels and both back foam pieces secured in place and the bottom cover piece glued in position.

FIG. 31 shows a bottom view of the treeless saddle wherein bottom cover piece 130 is stretched over back pads 242 and back panels 234, and is glued and sewn in place on saddle body 106. After the bottom cover 130 is secured in place, the bottom side of the saddle defines recessed gullet region 138 positioned between outwardly extending back contacting regions 246. Back contacting regions 246 each extend outwardly from the saddle body a greater distance in forward region 248 than in a rearward region 250. This difference in the thickness of the back panels and pads compensates for the large forces applied to the shoulder region of the saddle and horse during eventing, such as when the full weight of the rider may be supported by the horse's shoulders as the horse descends from an obstacle. Moreover, back contacting regions 246 each include a sculpted or cutaway region 252 that provides for close contact of the rider's inner thigh with the horse's back.

Still referring to FIG. 31, after bottom cover 130 is secured in place around back contacting regions 246, a front edge 254 of the bottom cover 130 is pulled upwardly and over the front edge of the saddle. Pommel cover 182 (FIG. 30) is then pulled forwardly and downwardly around the front edge of the saddle, and over the front edge 254 of bottom cover 130. The front edge of the saddle is then glued and sewn. Similarly, a back edge 256 of bottom cover 130 is pulled upwardly and over the rear edge of the saddle. Cantle back cover 212 (FIG. 22) is then pulled rearwardly and downwardly around the rear edge of the saddle, and over the rear edge 256 of bottom cover 130. The rear edge of the saddle is then glued and sewn. This results in the finished saddle body shown in FIG. 2, although additional components may still be removably added to the saddle. These additional components will be addressed in the remaining figures.

Figure 33:
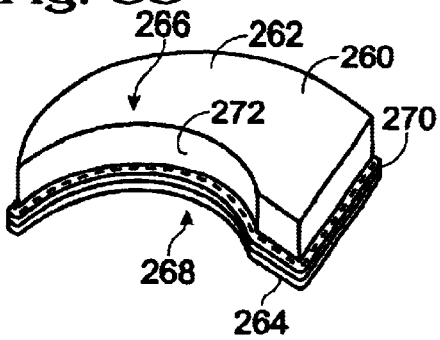
FIG. 33 is a perspective view of the assembled shoulder column.
Figure 32:
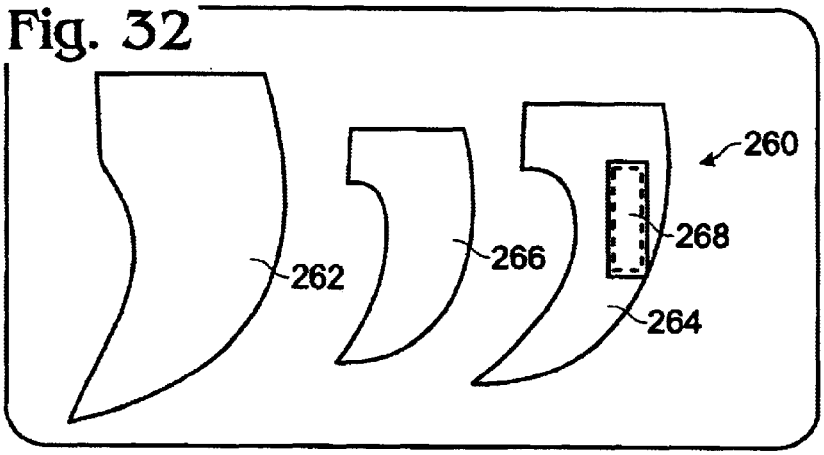
FIG. 32 is a top view of the components of a shoulder column.

FIGS. 32 and 33 show the components and the assembled version, respectively, of a shoulder column 260. Column 260 includes a top piece 262, a bottom piece 264, and a shoulder column pad 266. Top piece 262 and bottom piece 264 may be manufactured of heavy pebble leather, and pad 266 may be manufactured of one (1) inch thick MLC foam. A fastener 268, such as a five point five (5.5) inch long strip of hook or pile material typically is sewn to a bottom surface of bottom piece 264. The shoulder column is secured together with pad 266 glued between the top piece 262 and the bottom piece 264, and the top and bottom pieces sewn together along their edges with stitching 270. Shoulder column 260 defines a contoured region 272 shaped to receive the knee of the rider while still conforming to the rearward curve of the horse's shoulder. Fastener 268 is positioned on an underside of shoulder column 260 so that the fastener may be releasably and adjustably secured to fasteners 68 (shown in FIG. 30) on the underside 54 of each of half sections 56 and 104 of saddle body 106. In this manner, additional padding and thickness may be added to the forward region of the treeless saddle which is particularly useful during rigorous riding conditions, such as during descents over obstacles in eventing competition.

Figure 34:
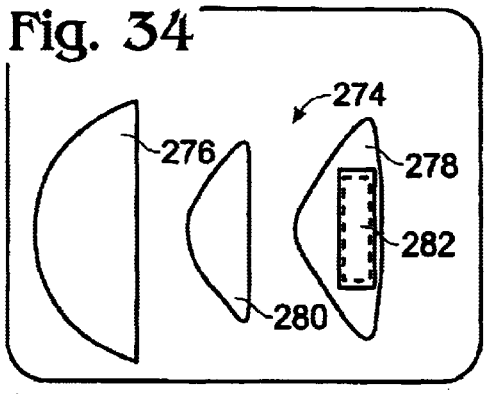
FIG. 34 is a top view of the components of a thigh block.
Figure 35:
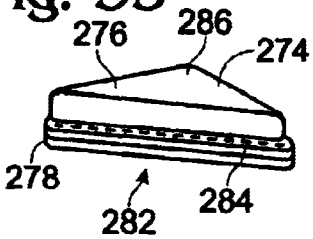
FIG. 35 is a perspective view of the assembled thigh block.

FIGS. 34 and 35 show the components and the assembled version, respectively, of a rear thigh block 274. Thigh block 274 includes a top piece 276, a bottom piece 278, and a thigh block pad 280. Top piece 274 may be manufactured of soft leather, bottom piece 276 may be manufactured of nine pound latigo leather, and pad 280 may be manufactured of one (1) inch thick, pre-molded 2-PPM. A fastener 282, such as a three point five (3.5) inch long strip of hook or pile material typically is sewn to a bottom surface of bottom piece 278. The thigh block is secured together with pad 280 glued between the top piece 276 and the bottom piece 278, and the top and bottom pieces sewn together along their edges with stitching 284. Thigh Block 274 defines an outwardly extending corner region 286 shaped to be received within the back region of the rider's bent knee. Fastener 282 is positioned on an underside of thick block 274 so that the fastener may be releasably and adjustably secured to fasteners 94 (shown in FIG. 22) on the topside 92 of each of half sections 56 and 104 of saddle body 106, while remaining hidden from view under leg flaps 216. The corner 286 of the thigh block is generally positioned pointing toward the front the saddle. In this manner, additional padding and thickness may be added to the rearward region of the treeless saddle while giving the rider added stability at the back of the thigh, which is particularly useful during rigorous riding conditions, such as during ascents over obstacles in eventing competition.

FIGS. 36 and 37 show the components and the assembled version, respectively, of a gullet supplement 290. Gullet supplement 290 includes a cover piece 292 and a gullet pad 294. Cover piece 292 may be manufactured of soft leather and gullet pad 294 may be manufactured of one (1) inch thick, seventeen (17) inch long, three (3) inch wide MLC foam. A fastener 296, such as a five point five (5.5) inch long strip of hook or pile material typically is sewn to an outer surface of cover piece 292. The gullet supplement is secured together with cover piece 292 wrapped around pad 294, the pad 294 glued within the cover piece, and cover piece 292 sewn together along its edge with stitching 298. Gullet supplement 290 typically is manufactured so as to fit within gullet region 138 (shown in FIG. 31) of the underside of the treeless saddle. Fastener 296 is positioned on an underside of gullet supplement 290 so that the fastener may be releasably and adjustably secured to fastener 136 (shown in FIG. 31) in gullet region 138. In this manner, additional padding and thickness may be added to the gullet region of the treeless saddle in cases where a rider desires the saddle to conform to the entire back of the horse, such as when the horse is particularly wide in its withers region. In situations where the rider desires the saddle to sit slightly upwardly from the spine of the horse, the gullet supplement may be removed, such as when the horse is particularly narrow in its withers region. Accordingly, the gullet supplement 290 gives the rider added lateral stability within the saddle, depending on the build of their horse, which is particularly useful during rigorous riding conditions, such as during sharp turns in eventing competition.

FIG. 38 shows the fully assembled, treeless, flexible saddle 40 of the present invention secured to a horse and in use during ascent over an obstacle. Due to the lack of a rigid frame or tree, saddle 40 is capable of movement in all directions, i.e., along each of the x, y and z axes such that the saddle may be bent and folded in virtually every direction. In other words, a cantle region 300 is capable of upwardly forward movement toward a pommel region 302, and pommel region 302 is capable of upwardly rearward movement toward cantle region 300. Such movement, or flexure, of the saddle will tend to lower a seat region 304 with respect to the upwardly extending pommel and cantle regions. The cantle and pommel regions are also capable of downward and outward movement in opposite directions so that the saddle will tend to become relatively flatter or more stretched out when needed. Such movement of the saddle may occur during galloping or jumping of a horse on which the saddle is mounted. Saddle 40 of the present invention can also be twisted such that a left portion of cantle region 300 is bent toward a right portion of pommel region 302, or a right portion of cantle region 300 may be bent toward a left portion of pommel region 302. This twisting of the saddle may occur during tight or abrupt turns of the horse. Regardless of the flexure or contortions through which the saddle moves, seat region 304 generally will be positioned lower than pommel region 302 and cantle region 300 such that the rider fits comfortably and securely within the contoured seat region of the saddle. The raised positioning of the pommel and cantle of the present invention, which forms a contoured seat for the rider, is due to foam pads, rather than the upward extensions of a rigid frame or tree.

The jumping saddle, as shown with reference to the embodiment described, further includes many adjustable and removable features which provide for added contoured support of the rider, without the use of a rigid saddletree to provide such a contoured shape. In particular, saddle 40 includes removable and adjustable thigh blocks 274 (FIG. 35), shoulder columns 260 (FIG. 33) and a gullet supplement 290 (FIG. 37). The treeless saddle 40 further includes back contacting regions 246 (FIG. 31) which provide room for the horse's spine therebetween, and each back contacting region defines a sculpted region 252 (FIG. 31) that provides room for the horse's shoulders. The removable gullet supplement may be positioned within the space between back contacting region 246 to define a saddle that contacts the horse across its entire back.

Due to the slight curvature of upper edges 60 of the half body sections, central seam 108 of the saddle body has an arched shape similar to that of a horse's back. Accordingly, the treeless saddle of the present invention generally retains its arched shape without the need for a rigid tree or frame. Moreover, the side panels of the saddle may each move inwardly or outwardly to accommodate horses of varying sized girths, and to move in response to breathing and striding of the horse.

Due to the treeless, flexible nature of saddle 40, the only material positioned between the rider and the horse is flexible leather and foam pads. This construction provides increased comfort to both horse and rider and reduces the chance of injury to the horse's back or shoulders. Moreover, due to the flexible nature of the saddle, which moves in conformity with each and every movement of the horse, the treeless flexible saddle of the present invention allows a rider to instantly feel the horse's movements, and allows the horse to instantly sense the movements of the rider, thereby allowing the rider to ride in a state of complete harmony and communication with his horse.

The leather pieces of the saddle of the present invention typically are a classic brown leather color. However, other colors or types of leather, and other durable materials may be used for manufacture of the saddle. Moreover, the saddle of the present invention may be manufactured in any size and with modifications to the method described herewith, while still retaining the invention features of the present invention.

Referring still to FIG. 38, saddle 40 is shown secured by a girth strap 306 on a horse, with a soft saddle pad 308 positioned between the saddle and the horse. Stirrups 310 are secured to the stirrup hangers (FIG. 19). The saddle preferably is secured to the horse rearwardly of the scapula of the horse, by at least two (2) inches, when the horse is in the standing position. However, during rigorous eventing conditions, as shown in this figure, the horse 312 is shown with its front left legs 314 elevated, such that its scapula 316 is rotated rearwardly, also referred to a posterior oscillation of the scapula. The humerus 318 is rotated forwardly thereby closing the angle between the scapula and the humerus. In this elevated leg position, a rear edge of scapula 316 is positioned underneath saddle 40. However, due to the sculpted shape of back contacting regions 246 (FIG. 31), the saddle provides room for movement of the horses shoulder so that the saddle does not hinder movement of the horse. The raised pommel and cantle are also shown providing a contoured seat area for receiving a rider 320.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

I claim:

1. A flexible, treeless saddle comprising:

a non-rigid saddle body manufactured of flat, flexible material and having a smooth, continuous lower surface and a top surface that defines a seat region;

a non-rigid back contacting pad secured to said lower surface of said saddle body, said back contacting pad defining a recessed gullet region extending along a central region of said saddle body;

a non-rigid pommel manufactured of flexible material, secured to said top surface, and extending upwardly from said seat region; and a non-rigid cantle manufactured of flexible material, secured to said top surface, and extending upwardly from said seat region opposite said pommel such that said pommel, said cantle and said seat region define a contoured seat adapted for receiving a rider.

2. The saddle of claim 1 wherein said back contacting pad includes first and second back contacting pads positioned on opposite sides of said recessed gullet region.

3. The saddle of claim 1 wherein said back contacting pad includes first and second sculpted regions each positioned to received one of the inner thighs of a rider.

4. The saddle of claim 1 further comprising a removable thigh block.

5. The saddle of claim 1 further comprising a removable shoulder column.

6. The saddle of claim 1 further comprising a removable gullet supplement sized to fit within said recessed gullet region.

7. The saddle of claim 1 wherein said pommel defines a cutout region adapted for receiving the neck of a horse when said saddle is mounted thereon.

8. A method of manufacturing a fully flexible saddle, comprising the steps of:

providing a flexible, substantially flat saddle body, wherein said saddle body includes a smooth underside and a smooth topside;

securing a flexible pommel to said topside of said saddle body such that said pommel extends upwardly from said topside;

securing a flexible cantle to said topside of said saddle body such that said cantle extends upwardly from said topside, wherein said pommel, said cantle and said topside together define a recessed seat region between said pommel and said cantle; and securing a flexible pad to said underside of said saddle body such that said pad extends downwardly from said underside, and wherein said flexible pad defines a recessed gullet region.

9. The method of claim 8 wherein said flexible pad comprises first and second pads each secured to said underside of said saddle body such that said first and second pads define said recessed gullet region therebetween.

10. The method of claim 8 wherein said flexible pad defines first and second cutout regions positioned to receive a rider's inner thigh.

11. The method of claim 8 further comprising adjustably securing a thigh block to said saddle.

12. The method of claim 8 further comprising adjustably securing a shoulder column to said saddle.

13. The method of claim 8 further comprising adjustably securing a gullet pad within said recessed gullet region.

14. A frameless, flexible saddle comprising:

a substantially flat, bendable saddle body defining a substantially flat, underside including first and second side regions, and a seat region positioned opposite said underside;

a flexible cantle secured to and extending upwardly from said seat region;

a first pad secured to said underside of said saddle body in said first side region;

a second pad secured to said underside of said saddle body in said second side region, wherein said first and second pads define a recessed region therebetween; and wherein said saddle body is flexible individually and simultaneously along each of x, y and z axes.

15. The flexible saddle of claim 14 further comprising a flexible pommel secured to and extending upwardly from said seat region opposite said flexible cantle.

16. The flexible saddle of claim 14 wherein said recessed region defines a gullet extending along a length of said saddle.

17. The flexible saddle of claim 14 further comprising a gullet pad removably secured within said recessed region.

18. The flexible saddle of claim 14 further comprising a removable thigh block and a removable a shoulder panel.

19. The flexible saddle of claim 14 wherein said first pad and said second pad each include a contoured section in a forward region thereof.

20. A flexible, treeless saddle comprising:

a non-rigid saddle body manufactured of flat, flexible material and having a smooth, continuous lower surface and a top surface that defines a seat region;

a non-rigid pommel manufactured of flexible material, secured to said top surface, and extending upwardly from said seat region;

a non-rigid cantle manufactured of flexible material, secured to said top surface, and extending upwardly from said seat region opposite said pommel such that said pommel, said cantle and said seat region define a contoured seat adapted for receiving a rider; and a shoulder column removably secured to said saddle body.

21. The saddle of claim 20 further comprising a thigh block removably secured to said saddle body.

22. The saddle of claim 20 further comprising a non-rigid back contacting pad secured to an underside of said saddle body, said back contacting pad defining a recessed gullet region extending along a central region of said saddle body.

* * * * *